United States Patent [19]

Coleman

[11] Patent Number: 4,785,647

[45] Date of Patent: Nov. 22, 1988

[54] METHOD AND APPARATUS FOR SIZING RINGS

[76] Inventor: Sammy L. Coleman, 5125 Highway 16, Rapid City, S. Dak. 57701

[21] Appl. No.: 107,005

[22] Filed: Oct. 8, 1987

[51] Int. Cl.[4] ..... B21B 5/00; B21D 53/44

[52] U.S. Cl. ..... 72/74; 72/109; 29/8

[58] Field of Search ..... 29/8, 160.6; 63/15.45, 63/15.5, 15.6, 15; 72/74, 109

[56] References Cited

U.S. PATENT DOCUMENTS

| | | | |
|---|---|---|---|
| 110,587 | 12/1870 | Palmer | 29/160.6 |
| 455,430 | 7/1891 | Peckham | 72/109 |
| 681,080 | 8/1901 | Simonds | 72/109 |
| 802,784 | 10/1905 | Remington | 72/74 |
| 896,428 | 8/1908 | Anderson | 29/8 |
| 1,591,255 | 7/1926 | Wilson | 29/8 |
| 2,440,536 | 4/1948 | Begley | 72/210 |

FOREIGN PATENT DOCUMENTS

| | | | |
|---|---|---|---|
| 597921 | 12/1925 | France | 29/8 |
| 218635 | 11/1924 | United Kingdom | 29/8 |
| 351249 | 6/1931 | United Kingdom | 29/8 |

*Primary Examiner*—Lowell A. Larson

*Attorney, Agent, or Firm*—Zarley, McKee, Thomte, Voorhees & Sease

[57] ABSTRACT

A ring sizer includes a handle assembly which rotates about a post with first roller and gear mounted on the post to cooperate with a second roller and gear on the handle assembly. A rotatable handle on the handle assembly moves the second roller and gear towards the first roller and gear. A pair of keeper pins on the handle assembly hold a ring on the first roller while the second roller exerts pressure on the ring shank to lengthen it. A groove in the second roller matches the cross-section of the ring shank to eliminate stretch marks and marring on the ring shank. The ring has a shank with a thick portion diametric to the jewel portion. The method of using a ring sizer calls for tightening the grooved roller adjacent the non-thick portions of the shank, so that no dents are caused in the shank. Beveled edges in the shank eliminate stretch marks and sharp edges during sizing.

12 Claims, 3 Drawing Sheets

METHOD AND APPARATUS FOR SIZING RINGS

TECHNICAL FIELD

This invention relates generally to an improved ring sizer for enlarging the size of rings, and a method for sizing rings.

BACKGROUND OF THE INVENTION

In state of the art jewelry, rings have a constant thickness shank portion. When placed on a conventional ring sizer, a pressure roller will squeeze the shank and cause it to become thinner and lengthen slightly. However, upon initial contact with the shank the conventional ring sizer will force a dent into the shank. It has been found that each time the shank is dented (as the pressure roller is forced to increase pressure on the ring shank) these dents are stretched out during the rolling process, causing flat portions on the shank. Once the ring is the appropriate size, the jeweler must then polish and grind the shank to remove these unsightly flat spots, and to polish the rolled surface of the stretched shank.

Typically, the flat inner surface of the shank of the ring meets the arcuate circumferal surface of the shank at a sharp edge. This edge is made even sharper by conventional ring sizers. This sharp edge will also show the stretch marks which occur during the rolling in the sizing of the ring. Thus, the jeweler must also grind and polish the ring shank to remove these sharp edges and stretch marks after sizing.

Most department stores do not sell silver rings because of the expense in sending the rings out to be accurately sized. It can be seen that conventional rings and ring sizers require additional expensive equipment in order to grind and polish the rings after the conventional sizing process. The cost of silver is not high enough to make it economically feasible to send the rings out to be sized, nor is the cost of silver low enough to allow the store to keep a stock of all sizes on hand. As discussed above, conventional ring sizing equipment is quite expensive and is not typically easily used by unskilled labor. Thus, silver rings have not been a viable product for department store sale.

Similarly, gold rings are sent out for sizing because of the cost of obtaining and maintaining expensive sizing equipment and accessory grinding and polishing equipment. Skilled labor is also necessary. While the cost of gold makes it economically feasible to send these jobs out, it would be desirable to provide this service in the store.

It is therefore a principal object of this invention to provide an improved method and apparatus for enlarging rings.

Another object is to provide a ring sizer which is simple to operate.

Still another object of the invention is to provide a ring with a variable thickness shank which enhances its ability to be easily sized using the apparatus and method of this invention.

A further object is to provide a ring sizer which simultaneously polishes the ring shank as it enlarges the ring.

Yet another object is to provide a ring with a shank which will eliminate sharp edges or stretch marks upon sizing using the apparatus and method of this invention.

Still another object of the present invention is to provide an improved ring sizer which is economical to manufacture, durable in use and refined in appearance.

These and other objects of the present invention will be apparent to those skilled in the art.

SUMMARY OF THE INVENTION

The improved ring sizer of the present invention includes a handle assembly which rotates about a post. A first roller and gear on the post cooperate with a second roller and gear on the handle assembly to rotate the second roller and gear when the handle assembly is moved around the post. A rotatable handle on the handle assembly moves the second roller and gear into engagement with the first roller and gear. A pair of keeper pins on the handle assembly hold a ring on the first roller while the second roller exerts pressure on the ring shank to lengthen it. A groove in the second roller matches the cross section of the ring shank to eliminate stretch marks and marring on the ring shank. The ring has a shank with a thick portion diametric to the jewel portion which allows the ring to be enlarged without reducing the minimal amount of shank thickness necessary to maintain the integrity of the ring. The method of using a ring sizer calls for tightening the grooved roller adjacent the non-thick portions of the shank, so that no dents are caused in the shank. Beveled edges on the shank eliminate stretch marks and sharp edges during sizing.

DESCRIPTION OF THE PREFERRED EMBODIMENT

Figure 1:
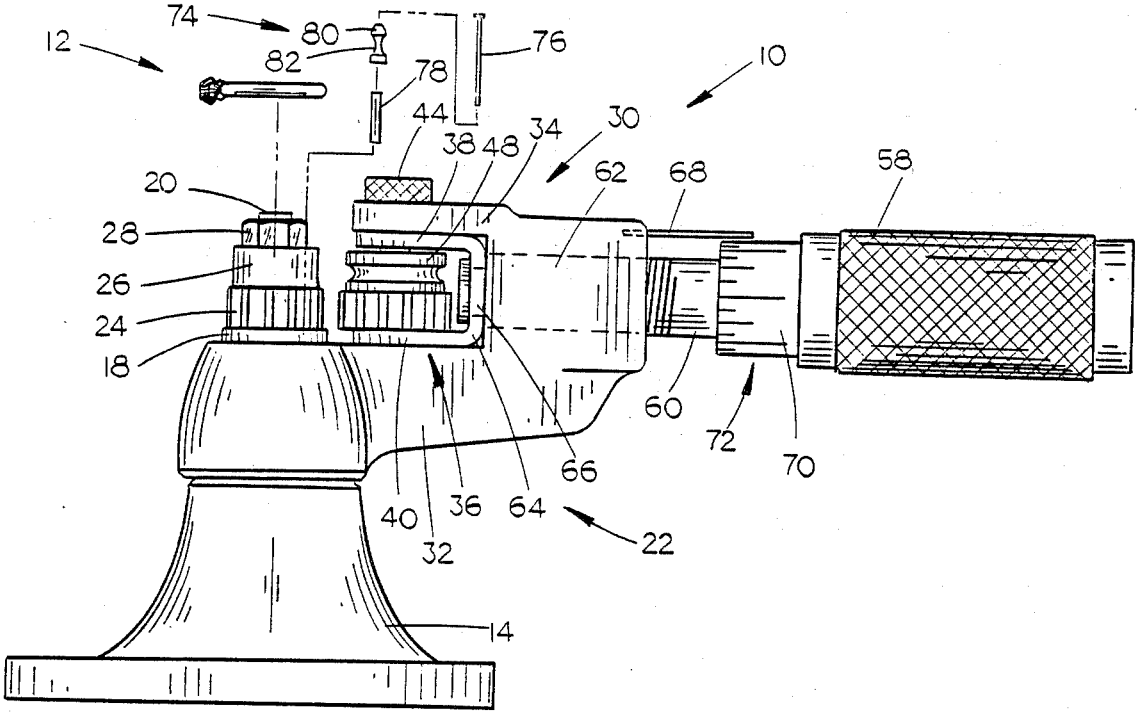
FIG. 1 is a side elevational view of the ring sizer of this invention.

Referring now to the drawings, in which the various reference numerals refer to the same or corresponding parts throughout the several views, the ring sizer of this invention is designated generally at 10 and will enlarge the size of a ring, designated generally at 12.

Ring sizer 10 has a base 14 which is adapted for mounting on a bench, board, or other support using bolts 16. Base 14 has a vertical shaft 18 projecting upward therefrom, and a vertical post 20 projects from the top of shaft 18. A handle assembly 22 is rotatably mounted on shaft 18, for rotation about shaft 18 in a generally horizontal plane. A spur gear 24 and cylindrical roller 26 are mounted on post 20 and fastened in place by a nut 28 threaded on the end of post 20. Spur gear 24 and roller 26 are fastened to post 20 so as to be non-rotatable.

Handle assembly 22 includes a U-shaped jaw portion 30, with one leg 32 rotatably mounted on shaft 18, and the other leg 34 spaced vertically above leg 32. Jaw portion 30 will rotate on leg 34 about the longitudinal axis of shaft 18, with the open portion between legs 32 and 34 directed radially towards post 20.

Figure 3:
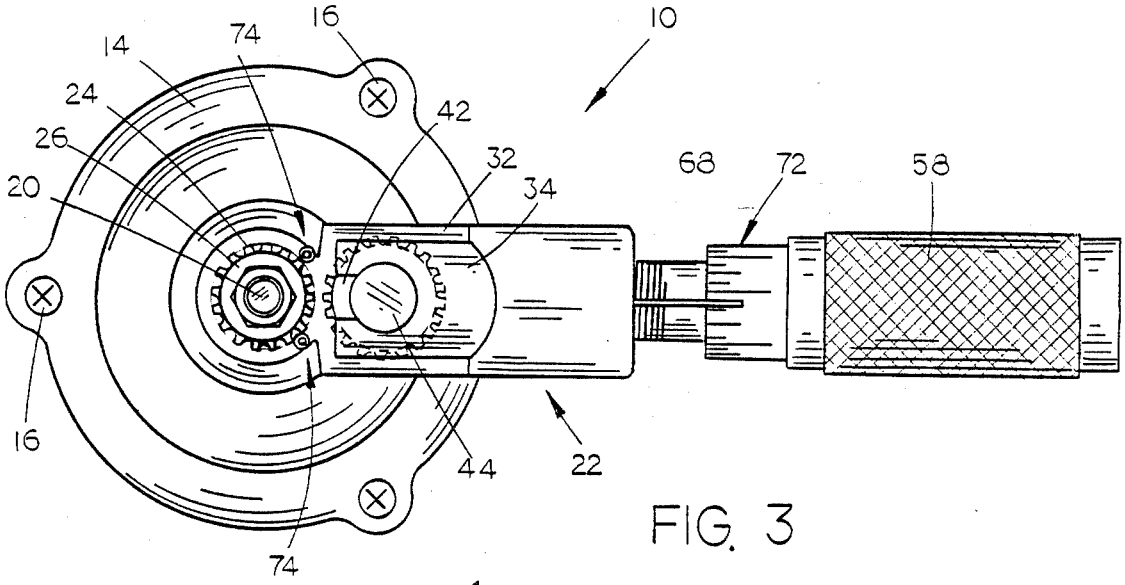
FIG. 3 is a top view of the ring sizer.

A U-bracket 36 is nested inside jaw portion 30 and has coaxial apertures (not shown) in its upper and lower legs 38 and 40, respectively. A slot 42 (see FIGS. 3 and 4) in upper leg 34 of jaw 30 enables a pin 44 to be inserted through the coaxial apertures in the legs of U-bracket 36 and rest on lower leg 32 of jaw portion 30. Slot 42 extends from the post-adjacent end of leg 34 towards the outer end of handle assembly 22, and radially from post 20. Pin 44 is slidable within slot 42 so that U-bracket 36 is slidable along a radial line towards and away from post 20 and spur gear 24.

A second spur gear 46 and a second roller 48 are rotatably mounted on pin 44 between legs 38 and 40 of U-bracket 36. Second spur gear 46 will mesh with spur gear 24 on post 20, and the cylindrical surface of the second roller 48 will bear against the cylindrical surface of roller 26 when bracket 36 slides towards post 20.

Figure 5:
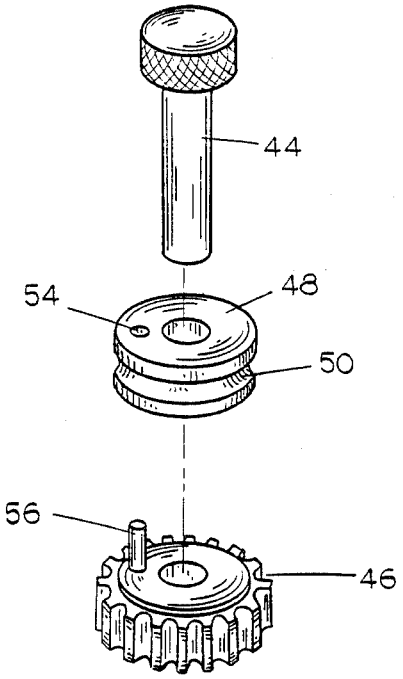
FIG. 5 is an exploded perspective view of the pressure roller apparatus of the ring sizer.

Referring now to FIG. 5, second roller 48 has an annular groove 50 cut in its circumferential surface. Groove 50 has a curvature which precisely matches the generally half-round curvature on the shank 52 of ring 12 (see FIG. 7). A small aperture 54 parallel to pin 44 corresponds with a peg 56 mounted on the upper face of spur gear 46. In this way, second roller 48 will rotate along with spur gear 46 on pin 44. Second roller 48 has a highly polished finish in its groove 50 and on its circumferential surface. It has been found that this highly polished finish will not mar the surface of the ring shank 52 during sizing. Thus, no shining or polishing of the sized ring is necessary after the sizing operation.

A knurled handle 58 has a threaded end portion 60 which projects through a horizontally-oriented threaded aperture 62 in jaw portion 30. Threaded aperture 62 extends through jaw portion 30 to the open portion between legs 32 and 34. Threaded end portion 60 of handle 58 is rotatably mounted through an aperture 66 to U-bracket 36. Thus, as the handle 58 is rotated, U-bracket 36 will slide inwardly toward post 20 within jaw portion 32.

A pin 68 is mounted to jaw portion 32 parallel to the longitudinal axis of handle 58, and extends adjacent end portion 60 as shown in the drawings. A stepped portion 70 on handle 58 has indicia 72 marked thereon, which corresponds with pin 68 to indicate the distance that handle 58 has been rotated relative to jaw portion 30. This in turn, relates proportionally to the distance that second roller 48 has been moved towards or away from roller 26 on post 20. Pin 68 extends closely adjacent stepped portion 70 so that indicia 72 may be accurately aligned therewith.

A pair of keeper pins 74 are mounted vertically on the lower leg 32 of handle assembly 22. Keeper pins 74 are positioned in the nip on each side of spur gears 24 and 46, and include a resilient spring wire 76 affixed in lower leg 32. A brass sleeve 78 slides over spring wire 76 and rests on the surface of leg 32 of jaw portion 30. Sleeve 78 is shorter than spring wire 76, such that an enlarged head portion 80 may be rotatably mounted on the remaining exposed portion of spring wire 76. Head portion 80 has an annular groove 82 therein which will correspond with groove 50 in roller 48 to hold ring 12 in position. The top end of spring wire 76 is enlarged to hold head 80 thereon. Keeper pins 74 are mounted sufficiently close to roller 26 bias head portions 80 against the shank of ring 12 and hold it in a horizontal position on roller 26. Since spring wire 76 is resilient, ring 12 can be snapped into and out of position on roller 26.

Figure 7:
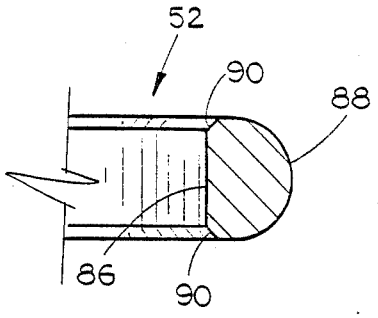
FIG. 7 is an enlarged sectional view taken at lines 7—7 in FIG. 6.
Figure 6:
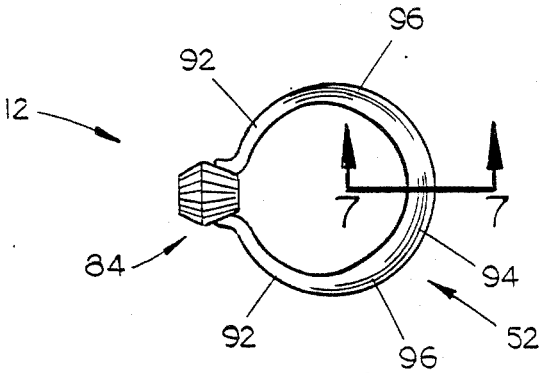
FIG. 6 is an enlarged side elevational view of a ring with a shank shaped for use on the ring sizer of this invention.

Referring now to FIGS. 6 and 7, ring 12 includes a shank portion 52 and a jewel portion 84. While jewel portion 84 of ring 12 is shown in the figures as having a gemstone, it should be noted that this description is merely utilized to locate the various portions of the ring shank 52. A gemstone is not a necessary element of the ring 12 utilized with the ring sizer 10 of this invention. Shank 52 has a generally half-round cross section, with a flat surface 86 forming the inner surface of the shank. The intersections of the flat inner surface 86 and the arcuate outer surface 88, have bevels 90 as shown to eliminate a sharp intersection. This beveling of the edges also eliminates the stretch marks which would form in the sharp edges of conventional ring shanks during sizing.

Conventional ring shanks have a constant thickness (as measured perpendicularly from the inner flat surface 86 to the most distal point on the outer curved surface 88 of a cross section of the shank) and width (as measured across the flat surface 86 of the inner portion in a cross-section of the shank) along their entire length. However, the applicant has provided a shank 52 which varies in thickness, and thereby eliminates the problems noted in the prior art.

FIG. 6 shows an exaggerated and enlarged view of a size 6 ring. Approximately one-half of shank 52, one quarter of the shank adjacent each side of jewel portion 84, is of a conventional thickness and is designated as portions 92 in the drawings. A thickened portion 94 diametric to jewel portion 84 extends a length of about $\frac{3}{8}$ of the total shank length. A tapered portion 96 connects the thick portion 94 and conventional, or "thin", portions 92. Preferably, on silver rings, thin portions 92 are approximately 1.2 millimeters thick will thick portion 94 is about 1.5 millimeters thick, the difference in thickness being unnoticeable to the naked eye. Gold rings are preferably manufactured with thin portions 92 approximately 1.05 millimeters thick, and a thick portion 94 about 1.35 millimeters thick.

During sizing, approximately 0.1 millimeter of thick portion 94 is utilized to extend the overall length of shank 52 one ring size. It has been found that a ring can be sized between 2 and $2\frac{1}{2}$ sizes larger and still maintain the integrity of the ring before the work-hardening of the metal causes distortion.

For smaller rings, the length of thick portion 94 would be increased to about one-half the total length of the shank, while the thin and tapered portions of the shanke are proportionately less.

Groove 50 in second roller 48 is cut to a specific depth determined by the specific material used in the ring shank. The depth is approximately 0.20 millimeters less than the thickness of thick portion 94 for a silver ring, and approximately 0.25 millimeters less than the thickness of the portion 94 for a gold ring. In this way, the ring shank will be totally encompassed by groove 50 when the ring has reached its maximum extent of enlargement at the shank's minimum thickness. This predetermined groove depth thereby automatically eliminates the possibility of oversizing a ring and damaging it. The ring could not be sized any lager than the minimum shank thickness since the circumferential surface of second roller 48 would press against first roller 26, rather than the ring shank, once the thickness of the ring shank is equal to the depth of groove 50. It can be seen that for silver rings, the groove depth of roller 48 would be about 1.3 millimeters, and for gold rings the groove depth would be about 1.1 millimeters. The specific groove depth for the material also eliminates the need for the large number of various sizes of groove rollers currently used by conventional ring sizers.

Figure 2:
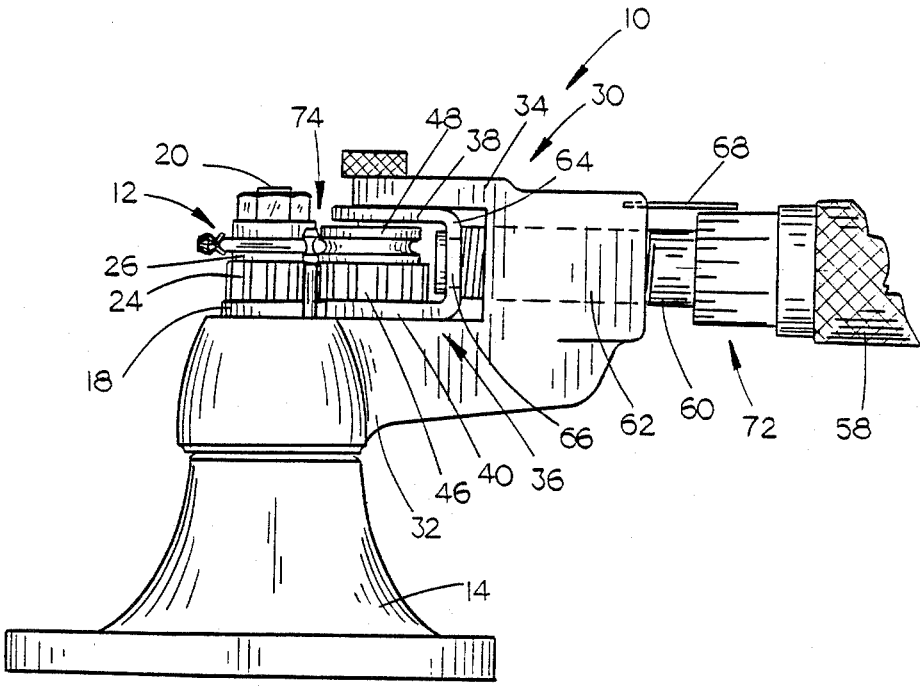
FIG. 2 is a side view of the ring sizer in its operative position.

In operation, handle 58 is first turned counter-clockwise in order to pull second roller 48 away from roller 26. Ring 12 is then placed over roller 26, and shank 52 of ring 12 is snapped into place between roller 26 and the pair of keeper pins 74. Keeper pins 74 will hold ring 12 in horizontal alignment with groove 50 of roller 48. Deviation from a horizontal alignment can cause variations in the shank thickness, or "lumpy" out-of-round portions. Handle assembly 22 is then moved around shaft 18 until it is diametric to jewel portion 84 of ring 112. Handle 58 may then be turned clockwise until roller 48 contacts shank 52 of ring 12, as shown in FIG. 2.

Figure 4:
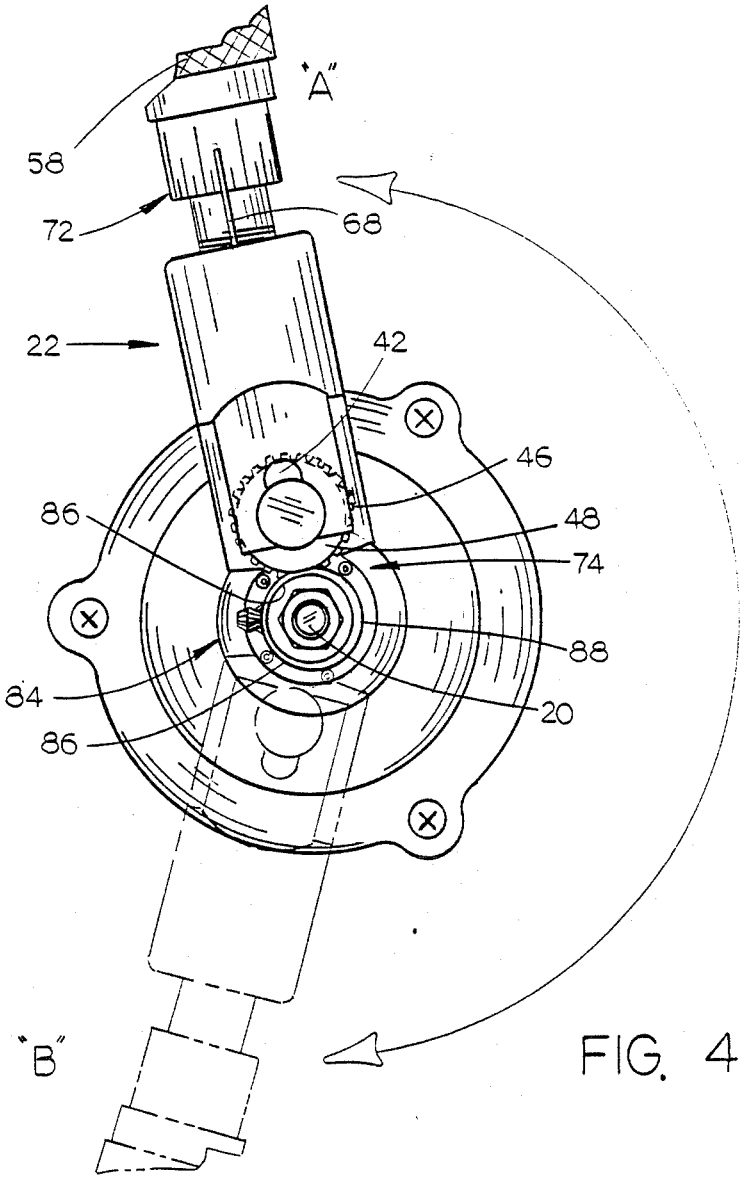
FIG. 4 is a top view of the ring sizer in operative positions.

Handle assembly 22 is then moved around ring 12 until reaching position "A", shown in FIG. 4. Keeper pin 74 will stop handle assembly 22 from coming too close to jewel portion 84 of ring 12, while simultaneously positioning roller 48 adjacent thin portion 92 of shank 52. Handle 58 is then turned clockwise approximately 1/16 of an inch, which is indicated by pin 68 with reference to indicia 72. Handle assembly 22 is moved around ring shank 52, applying pressure on thick portion 94, until position "B" is reached (see FIG. 4). Handle 58 may again be tightened and handle assembly 22 moved around ring shank 52, thereby gradually lengthening shank 52 and enlarging the size of ring 12 by decreasing the thickness of thick portion 94 of shank 52.

Because handle 58 is tightened when roller 48 is adjacent the thin portion 92 of shank 52, the roller 48 will not cause a dent in shank 52. Pressure will only come to bear on shank 52 where the thickness increases gradually, at tapered portion 96, and will be at full pressure across the entire thick portion 94.

Frequent checking of the ring size is recommended, so as to ensure a good fit. Because of the highly polished grooved roller 48, the sized ring needs virtually no further polishing after sizing, and can be immediately returned to the owner.

It can therefore be seen that the invention fulfills at least all of the above-stated objectives.

I claim:

1. An improved ring sizer for ring having a shank portion, comprising, a base portion having post projection therefrom;

first gear means rigidly mounted on said post;

first cylindrical roller means rigidly mounted on said post;

a handle assembly rotatably mounted on said post for rotation about the longitudinal axis of said post;

second gear means rotatably connected to said handle assembly and slidably mounted for radial movement relative to said post, for selective engagement with said first gear means;

second roller means connected to said second gear means for rotatable and slidable movement therewith;

rotatable handle means mounted on said handle assembly and operably connected to said second gear means for selectively, adjustably sliding said second gear means towards and away from engagement with said first gear means;

said second roller means further characterized as having an annular groove in its circumferential surface, said groove lying within a plane perpendicular to the longitudinal axis of said second roller means and having a cross-section which matches the circumferential curve of the cross-setcion of the ring;

said second roller means having a highly polished groove and circumferential surface, whereby rolling of the roller on a ring's shank will not cause marring of the shank's surface; and means for holding the shank portion of said ring in a generally horizontal plane around said first roller means in alignment with said groove in said second roller means, whereby the movement of said handle assembly about said post will cause the groove on said second roller means to engage the shank and lengthen it;

said ring holding means including a pair of generally vertical pins mounted on said handle assembly for rotation therewith, one said pin located in the nip on each side of said first and second roller means, said pins positioned to resiliently bias the shank of a ring against said first roller means during sizing thereof.

2. The ring sizer of claim 1, wherein said pins further include a head portion rotatably mounted on the upper end thereof, said head portion having an annular groove in its circumferential surface which lies in a generally horizontal plane aligned with the groove in said second roller means.

3. The ring sizer of claim 1, further comprising indicator means mounted on said handle assembly for indicating the amount of rotation on said handle relative to said handle assembly, said indicator means including a pin projecting generally parallel to said handle and adjacent thereto, and indicia marked around the circumference of said handle.

4. In combination:

a ring sizer, including a base portion having a vertical post projecting therefrom;

first gear means rigidly mounted on said post;

first cylindrical roller means rigidly mounted on said post;

a handle assembly rotatably mounted on said post for rotation about the longitudinal axis of said post;

second gear means rotatably connected to said handle assembly and slidably mounted for radial movement relative to said post, for selective engagement with said first gear means;

second roller means connected to said second gear means for rotatable and slidable movement therewith;

rotatable handle means mounted on said handle assembly and operably connected to said second gear means for selectively, adjustably sliding said second gear means towards and away from engagement with said first gear means;

said second roller further characterized as having an annualar groove in its circumferential surface, said groove lying within a plane perpendicular to the longitudinal axis of said second roller means and having a cross-section which matches the circumferential curve of the cross-section of the ring;

said second roller means having a highly polished groove and circumferential surface, whereby rolling of the roller on a ring's shank will not cause marring of the shank's surface;

means for holding a ring in a generally horizontal plane around said first roller means and in alignment with said groove in said second roller means;

said ring holding means including a pair of generally vertical pins mounted on said handle assembly for rotation therewith, one said pin located in the nip on each side of said first and second roller means, said pins positioned to resiliently bias the shank of a ring against said first roller means during sizing thereof;

a ring for use on said ring sizer, having a jewel portion and shank;

said shank being generally half-round in cross-section, with a flat inner surface;

said shank having a thick portion diametric to said jewel portion, the length of said thick portion being about one-fourth to one-half the total length of the shank said thickness being measured perpendicularly from the flat inner surface of the shank to the most distal point on the arcuate circumferential surface.

5. The combination of claim 4, wherein the shank of said ring is comprised of a silver alloy material and is about 1.2 millimeters thick with a thick portion about 1.5 millimeters thick.

6. The combination of claim 4, wherein the shank of said ring is comprised of a gold alloy material and is about 1.05 millimeters thick, with a thick portion about 1.35 millimeters thick.

7. The combination of claim 4, further including a tapered shank portion between each end of said thick portion and the non-thick portions of the shank.

8. The combination of claim 7, wherein said thick portion and said non-thick portions are of a constant thickness.

9. The combination of claim 4, whrein the edges forming the intersection of the flat inner surface of the shank with the arcuate circumferential portion, are beveled.

10. The combination of claim 4, wherein said groove has a cross-section which matches the circumferential curve of the cross-section of said ring shank and substantially encompasses said circumferential curve, and wherein said groove has a predetermined depth which is equal to the minimum thickness to which the thick portion of the ring shank may be reduced during sizing.

11. A method for lengthening the shank of ring, comprising the steps of:

(a) providing a ring sizer having a base portion with a vertical post projecting therefrom; a first gear and roller means mounted on said post; a handle assembly rotatably mounted on said post for rotation about the longitudinal axis of the post; the handle assembly having second gear and roller means rotatably and slidably mounted thereon for slidable movement along a radial from said post, said second gear means positioned for selective engagement with said first gear and roller means; rotatable handle means mounted on said handle assembly and operably connected to said second roller means for selectively, adjustably sliding said second gear and roller means towards said first gear and roller means; said second roller means having an annular groove in its circumferential surface, said groove having a cross-section which matches the circumferential curve of the cross-section of the ring; said second roller means having a highly polished groove and circumferential surface, whereby rolling of the roller on a ring's shank will not cause marring of the shank's surface; means for holding the shank of said ring in a generally horizontal plane around said first roller means and in alignment with said groove in said second roller means; said ring holding means including a pair of generally vertical pins mounted on said handle assmbly for rotation therewith, one said pin located in the nip on each side of said first and second roller means, said pins positioned to resiliently bias the shank of a ring against said first roller means during sizing thereof;

(b) Providing a ring having a jewel portion and a shank; the shank being generally half-round in cross-section and with a flat inner surface; said shank having a thick portion diametric to the jewel portion, the thickness being measured perpendicular from the flat inner surface of the shank to the most distal point on the arcuate circumferential surface, and two diametrically opposing non-thick portions located between said thick portion and said jewel portion;

(c) mounting said ring in said ring holding means on the first roller means;

(d) moving said handle assembly around said post to position said second roller means adjacent one of the non-thick portions of said shank;

(e) tightening said handle to move said second roller means towards said first roller means, to a point slightly less than the thickness of said thick portion away from said first roller means;

(f) moving said handle assembly around said post to position said second roller means adjacent the opposite non-thick portion;

(g) tightening said handle to move said second roller towards said first roller means;

(h) moving said handle back around said post to position said second roller means adjacent said one-thick portion; and (i) removing said ring from said ring sizer.

12. The method of claim 11, further comprising repeating steps (d) through (h) until the desired enlargement of the ring has been attained.

* * * * *